US010753155B2

(12) United States Patent
Maurstad

(10) Patent No.: US 10,753,155 B2
(45) Date of Patent: Aug. 25, 2020

(54) FIXED CUTTER STABILIZING DRILL BIT

(71) Applicant: VAREL INTERNATIONAL IND., L.L.C., Carrollton, TX (US)

(72) Inventor: Cary Andrew Maurstad, Livingston, TX (US)

(73) Assignee: VAREL INTERNATIONAL IND., L.L.C., Carrollton, TX (US)

( * ) Notice: Subject to any disclaimer, the term of this patent is extended or adjusted under 35 U.S.C. 154(b) by 145 days.

(21) Appl. No.: 16/161,661

(22) Filed: Oct. 16, 2018

(65) Prior Publication Data

US 2020/0011137 A1 Jan. 9, 2020

Related U.S. Application Data

(60) Provisional application No. 62/582,647, filed on Nov. 7, 2017.

(51) Int. Cl.

| | |
|---|---|
| ***E21B 10/43*** | (2006.01) |
| ***E21B 10/55*** | (2006.01) |
| ***E21B 10/567*** | (2006.01) |

(52) U.S. Cl.

CPC ..... *E21B 10/43* (2013.01); *E21B 10/55* (2013.01); *E21B 10/567* (2013.01)

(58) Field of Classification Search

CPC ..... E21B 10/43; E21B 10/55; E21B 10/567; E21B 2010/425

See application file for complete search history.

(56) References Cited

U.S. PATENT DOCUMENTS

| | | | | |
|---|---|---|---|---|
| 5,314,033 | A * | 5/1994 | Tibbitts | E21B 10/5673 175/430 |
| 7,441,612 | B2 * | 10/2008 | Durairajan | E21B 10/42 175/431 |
| 8,881,849 | B2 | 11/2014 | Shen | |
| 9,404,312 | B2 | 8/2016 | Azar | |
| 9,556,683 | B2 * | 1/2017 | Simmons | E21B 10/43 |
| 2006/0162968 | A1 * | 7/2006 | Durairajan | E21B 10/43 175/431 |
| 2010/0326742 | A1 * | 12/2010 | Vempati | E21B 10/43 175/431 |

* cited by examiner

*Primary Examiner* — Matthew R Buck

(57) ABSTRACT

A bit for drilling a wellbore includes: a body; and a cutting face including: a blade protruding from the body; and a row of cutters, each cutter including: a substrate mounted in a pocket formed adjacent to a leading edge of the blade; and a cutting table made from a superhard material, mounted to the substrate, and having a working face. A first subset of the row of cutters is oriented at a negative side rake angle. A second subset of the row of cutters is oriented at a zero or slightly positive side rake angle. The first and the second subsets are alternating. An innermost cutter of the first subset has a maximum absolute value of the negative side rake angle. The absolute value negative side rake angles of the rest of the cutters decrease as their distance from a center of the cutting face increases.

6 Claims, 1 Drawing Sheet

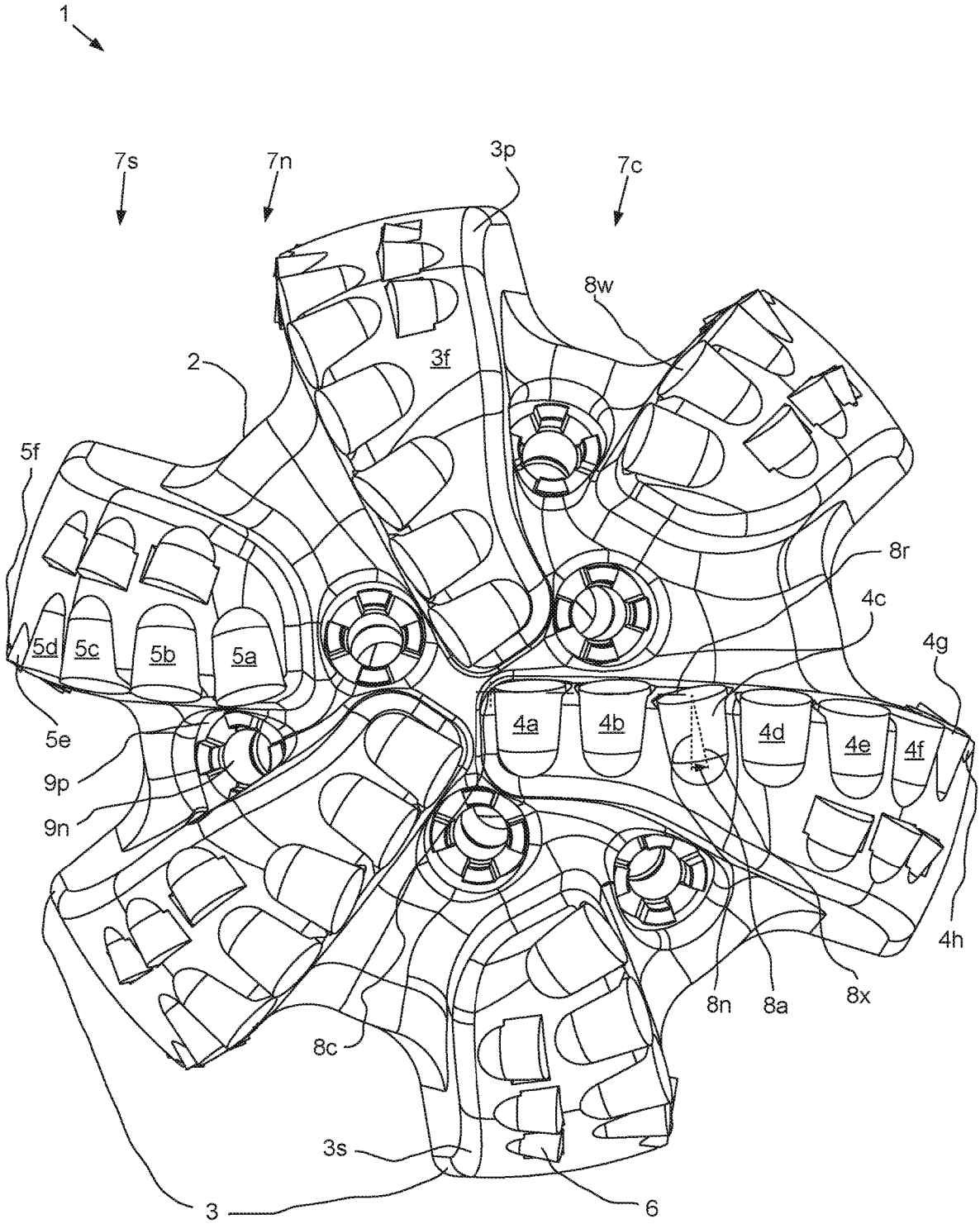
1
7s
7n
3p
7c
8w
2
3f
5f
8r
4c
4g
5d
5c
5b
5a
4a
4b
4d
4e
4f
5e
9p
9n
4h
8n
8a
8x
8c
3s
3
6

FIXED CUTTER STABILIZING DRILL BIT

BACKGROUND OF THE DISCLOSURE

Field of the Disclosure

The present disclosure generally relates to a fixed cutter stabilizing drill bit.

Description of the Related Art

U.S. Pat. No. 7,441,612 discloses a fixed cutter drill bit and a method for designing a fixed cutter drill bit including simulating the fixed cutter drill bit drilling in an earth formation. A performance characteristic of the simulated fixed cutter drill bit is determined. A side rake angle distribution of the cutters is adjusted at least along a cone region of a blade of the fixed cutter drill bit to change the performance characteristic of the fixed cutter drill bit.

U.S. Pat. No. 8,881,849 discloses a cutting tool having a tool body with a plurality of blades extending radially therefrom and a plurality of rotatable cutting elements mounted on at least one of the plurality of blades is disclosed, wherein the plurality of rotatable cutting elements are mounted on the at least one blade utilizing multiple side rake angles.

U.S. Pat. No. 9,404,312 discloses a downhole cutting tool including a tool body; a plurality of blades extending azimuthally from the tool body; and a plurality of cutting elements disposed on the plurality of blades, the plurality of cutting elements including: at least two conical cutting elements including a substrate and a diamond layer having a conical cutting end, wherein at least one of the at least two conical cutting elements has a positive back rake angle, and at least one of the at least two conical cutting elements has a negative back rake angle.

U.S. Pat. No. 9,556,683 discloses earth boring tools with a plurality of fixed cutters having side rake or lateral rakes configured for improving chip removal and evacuation, drilling efficiency, and/or depth of cut management as compared with conventional arrangements.

SUMMARY OF THE DISCLOSURE

The present disclosure generally relates to a fixed cutter stabilizing drill bit. In one embodiment, a bit for drilling a wellbore includes: a body; and a cutting face including: a blade protruding from the body; and a row of cutters, each cutter including: a substrate mounted in a pocket formed adjacent to a leading edge of the blade; and a cutting table made from a superhard material, mounted to the substrate, and having a working face. A first subset of the row of cutters is oriented at a negative side rake angle. A second subset of the row of cutters is oriented at a zero or slightly positive side rake angle. The first and the second subsets are alternating. An innermost cutter of the first subset has a maximum absolute value of the negative side rake angle. The absolute value negative side rake angles of the rest of the cutters decrease as their distance from a center of the cutting face increases.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 1 illustrates a cutting face of a fixed cutter stabilizing drill bit, according to one embodiment of the present disclosure.

DETAILED DESCRIPTION

FIG. 1 illustrates a cutting face of a fixed cutter stabilizing drill bit 1, according to one embodiment of the present disclosure. The drill bit 1 may include the cutting face, a bit body 2, a shank (not shown), and a gage section (not shown). A lower portion of the bit body 2 may be made from a composite material, such as a ceramic and/or cermet matrix powder infiltrated by a metallic binder, and an upper portion of the bit body 2 may be made from a softer material than the composite material of the upper portion, such as a metal or alloy shoulder powder infiltrated by the metallic binder. The bit body 2 may be mounted to the shank during molding thereof. The shank may be tubular and made from a metal or alloy, such as steel, and have a coupling, such as a threaded pin, formed at an upper end thereof for connection of the drill bit 1 to a drill collar (not shown). The shank may have a flow bore formed therethrough and the flow bore may extend into the bit body 2 to a plenum (not shown) thereof. The cutting face may form a lower end of the drill bit 1 and the gage section may form at an outer portion thereof.

Alternatively, the bit body 2 may be metallic, such as being made from steel, and may be hardfaced. The metallic bit body may be connected to a modified shank by threaded couplings and then secured by a weld or the metallic bit body may be monoblock having an integral body and shank.

The cutting face may include one or more (three shown) primary blades 3*p*, one or more (three shown) secondary blades 3*s*, fluid courses formed between the blades, rows of leading cutters 4*a-h*, 5*a-f*, and backup cutters 6. The cutting face may have one or more sections, such as an inner cone 7*c*, an outer shoulder 7*s*, and an intermediate nose 7*n* between the cone and the shoulder sections. The blades 3 may be disposed around the cutting face and each blade may be formed during molding of the bit body 2 and may protrude from a bottom of the bit body. The primary blades 3*p* and the secondary blades 3*s* may be arranged about the cutting face 3 in an alternating fashion. The primary blades 3*p* may each extend from a center 8*c* of the cutting face, across the cone 7*c* and nose 7*n* sections, along the shoulder section 7*s*, and to the gage section. The secondary blades 3*s* may each extend from a periphery of the cone section 7*c*, across the nose section 7*n*, along the shoulder section 7*s*, and to the gage section. Each blade 3 may extend generally radially across the cone 7*c* (primary only) and nose 7*n* sections with a slight spiral curvature and along the shoulder section 7*s* generally longitudinally with a slight helical curvature.

Each blade 3 may be made from the same material as the lower portion of the bit body 2. The leading cutters 4*a-h*, 5*a-f* may be mounted along leading edges of the blades 3 after infiltration of the bit body 2. The leading cutters 4*a-h*, 5*a-f* may be pre-formed, such as by high pressure and temperature sintering, and mounted, such as by brazing, in respective leading pockets formed in the blades 3 adjacent to the leading edges thereof. Each blade 3 may have a lower face 3*f* extending between a leading edge and a trailing edge thereof.

Starting in the nose section 7*n*, each blade 3 may have a row of backup pockets formed in the lower face 3*f* thereof and extending therealong. Each backup pocket may be aligned with or slightly offset from a respective leading pocket. The backup cutters 6 may be mounted, such as by brazing, in the backup pockets formed in the lower faces 3*f* of the blades 3. The backup cutters 6 may be pre-formed, such as by high pressure and temperature sintering.

Each cutter 4*a-h*, 5*a-f*, 6 may be a shear cutter and include a superhard cutting table, such as polycrystalline diamond, attached to a hard substrate, such as a cermet, thereby forming a compact, such as a polycrystalline diamond compact (PDC). The cermet may be a carbide cemented by a Group VIIIB metal, such as cobalt. The substrate and the cutting table may each be solid and cylindrical and a diameter of the substrate may be equal to a diameter of the cutting table.

A first subset 4*c,e,g* of each row of leading cutters 4*a-h* of each primary blade 3*p* and a first subset 5*a,c,e* of each row of leading cutters 5*a-f* of each secondary blade 3*s* may each be oriented at a negative side rake angle 8*a*. The side rake angle 8*a* may be defined by an inclination of a longitudinal axis 8*x* of each of the first subset cutters 4*c,e,g*, 5*a,c,e* relative to a respective line 8*n* tangent to a respective radial line 8*r* extending from the center 8*c* of the cutting face to a respective center of a working face 8*w* of the respective cutter about a respective inclination axis (not shown) normal to a respective projection (not shown) of the lower face 3*f* of the respective blade 3*p,s* at the center of the working face. In the view of FIG. 1, the polarity of the side rake angle 8*a* is negative for the counter-clockwise direction and positive for the clockwise direction.

Each first subset 4*c,e,g*, 5*a,c,e* may include a plurality of the respective leading cutters 4*a-h*, 5*a-f*. A second subset 4*a,b,d,f,h* of each row of leading cutters 4*a-h* of each primary blade 3*p* and a second subset 5*b,d,f* of each row of leading cutters 5*a-f* of each secondary blade 3*s* may each be oriented at a zero or slightly positive side rake angle 8*a*, such as zero to five degrees. The side rake angle 8*a* of each cutter of each second subset 4*a,b,d,f,h*, 5*b,d,f* may be equal. Each first subset 4*c,e,g*, 5*a,c,e* may be distinct from the respective second subset 4*a,b,d,f,h*, 5*b,d,f*. Each first subset 4*c,e,g*, 5*a,c,e* may alternate with the respective second subset 4*a,b,d,f,h*, 5*b,d,f*.

Each cutter of each first subset 4*c,e,g*, 5*a,c,e* may have a different negative side rake angle 8*a* than the rest of the cutters of the respective first subset. An innermost cutter 4*c*, 5*a* of each first subset 4*c,e,g*, 5*a,c,e* may have a maximum absolute value negative side rake angle and the absolute value negative side rake angles of the rest of the cutters may decrease as their distance from the center of the cutting face increases. The progressive decrease may be determined by subtracting a constant value from the absolute value negative side rake angle of the previous cutter or may be determined using computer-assisted modelling. The innermost cutter 4*c* of each first primary subset 4*c,e,g* may be the third cutter of the respective primary blade 3*p* and/or located in the cone section 7*c* or the nose section 7*n*. The innermost cutter 5*a* of each first secondary subset 5*a,c,e* may be the first cutter of the respective secondary blade 3*s* and/or located in the cone section 7*c* or the nose section 7*n*. The maximum absolute value negative side rake angle may range between ten and thirty degrees.

Alternatively, the innermost cutter of each first primary subset may be the second cutter 4*b* of the respective primary blade 3*p*. The first primary subset would then include the second, fourth, sixth, and eighth cutters. Alternatively, the first subsets 4*c,e,g*, 5*a,c,e* and/or the second subsets 4*a,b,d,f,h*, 5*b,d,f* may include shaped cutters having non-planar working faces 8*w*.

Alternatively, the drill bit 1 may further include shock studs protruding from the lower face 3*f* of each primary blade 3*p* in the cone section 7*c* and each shock stud may be aligned with or slightly offset from a respective leading cutter 9*p*.

One or more (six shown) ports 9*p* may be formed in the bit body 2 and each port may extend from the plenum and through the bottom of the bit body to discharge drilling fluid (not shown) along the fluid courses. A nozzle 9*n* may be disposed in each port 9*p* and fastened to the bit body 2. Each nozzle 9*n* may be fastened to the bit body 2 by having a threaded coupling formed in an outer surface thereof and each port 9*p* may be a threaded socket for engagement with the respective threaded coupling. The ports 9*p* may include an inner set of one or more (three shown) ports disposed in the cone section 7*c* and an outer set of one or more (three shown) ports disposed in the nose section 7*n* and/or shoulder section 7*s*. Each inner port 9*p* may be disposed between an inner end of a respective secondary blade 3*s* and the center 8*c* of the cutting face.

The gage section may define a gage diameter of the drill bit 1. The gage section may include a plurality of gage pads, such as one gage pad for each blade 3, and junk slots formed between the gage pads. The junk slots may be in fluid communication with the fluid courses formed between the blades 3. The gage pads may be disposed around the gage section and each pad may be formed during molding of the bit body 2 and may protrude from the outer portion of the bit body. Each gage pad may be made from the same material as the bit body 2 and each gage pad may be formed integrally with a respective blade 3. Each gage pad may extend upward from an end of the respective blade 3 in the shoulder section 7*s* to an exposed outer surface of the shank. Each gage pad may include a slightly recessed transition portion located adjacent to the shoulder section 7*s*, a full diameter portion extending from the transition portion, and a tapered portion extending from the full diameter portion to the shank.

Alternatively, the gage pads may have gage trimmers mounted into pockets formed therein, such as by brazing, and/or gage protectors embedded therein. The gage trimmers may each be shear cutters, similar to those discussed above. Each gage protector may be made from thermally stable PCD or PDC.

In use (not shown), the drill bit 1 may be assembled with one or more drill collars, such as by threaded couplings, thereby forming a bottomhole assembly (BHA). The BHA may be connected to a bottom of a pipe string, such as drill pipe or coiled tubing, thereby forming a drill string. The BHA may further include a steering tool, such as a bent sub or rotary steering tool, for drilling a deviated portion of the wellbore. The pipe string may be used to deploy the BHA into the wellbore. The drill bit 1 may be rotated, such as by rotation of the drill string from a rig (not shown) and/or by a drilling motor (not shown) of the BHA, while drilling fluid, such as mud, may be pumped down the drill string. A portion of the weight of the drill string may be set on the drill bit 1. The drilling fluid may be discharged by the nozzles 9*n* and carry cuttings up an annulus formed between the drill string and the wellbore and/or between the drill string and a casing string and/or liner string.

In certain operating windows (angular speed (RPM), weight on bit (WOB)), prior art fixed cutter drill bits tend to drill in an unstable motion creating a larger than desired hole with resulting cutting structure problems. Advantageously, inclusion of the first subsets 4*c,e,g*, 5*a,c,e* result in the drill bit 1 that will drill with stability in all operating windows necessary to drill a given formation. Further, the drill bit 1 will remain stable without sacrificing ROP while drilling. The drill bit 1 will have an increased lifespan, result in reduced stress imposed on other BHA members through reduced vibration, and will eliminate connection issues associated with BHA vibration. Further, the drill bit 1 can be produced without extensive manufacturing alteration.

While the foregoing is directed to embodiments of the present disclosure, other and further embodiments of the disclosure may be devised without departing from the basic scope thereof, and the scope of the invention is determined by the claims that follow.

The invention claimed is:

1. A bit for drilling a wellbore, comprising:

a body; and a cutting face comprising:

a blade protruding from the body; and a row of cutters, each cutter comprising:

a substrate mounted in a pocket formed adjacent to a leading edge of the blade; and a cutting table made from a superhard material, mounted to the substrate, and having a working face, wherein:

a first subset of the row of cutters is oriented at a negative side rake angle, a second subset of the row of cutters is oriented at a zero side rake angle, the first and the second subsets are alternating, an innermost cutter of the first subset has a maximum absolute value of the negative side rake angle, an absolute value of each of the negative side rake angles of the rest of the cutters decreases as their distance from a center of the cutting face increases, the maximum absolute value of the negative side rake angle ranges between 10 and 30 degrees, and the innermost cutter is located in a cone section of the cutting face.

2. The bit of claim 1, wherein:

the blade is a primary blade extending from the center of the cutting face, and the innermost cutter of the first subset is a second or a third cutter of the blade.

3. The bit of claim 2, wherein:

the cutting face further comprises a secondary blade protruding from the body and extending from a periphery of the cone section of the cutting face and a second row of cutters mounted to a leading edge of the secondary blade, a first subset of the second row of cutters is oriented at a negative side rake angle, a second subset of the second row of cutters is oriented at a zero side rake angle, the first and the second subsets of the second row are alternating, an innermost cutter of the first subset of the second row has a maximum absolute value of the negative side rake angle, and an absolute value of each of the negative side rake angles of the rest of the cutters of the second row decreases as their distance from the center of the cutting face increases, and the innermost cutter of the first subset of the second row is a first cutter of the secondary blade.

4. The bit of claim 1, wherein the cutting face further comprises a plurality of backup cutters mounted in a lower face of the blade.

5. The bit of claim 1, wherein:

the bit further comprises a shank having a coupling formed at an upper end thereof, and the body is mounted to a lower end of the shank.

6. The bit of claim 1, wherein all of the cutters of the drill bit are each oriented at a side rake angle less than or equal to zero.

* * * * *